US012578155B1

(12) United States Patent
Dere

(10) Patent No.: US 12,578,155 B1
(45) Date of Patent: Mar. 17, 2026

(54) AUTOMATIC FIREARM WITH PRESSURE CONTROLLED INERTIA MECHANISM

(71) Applicant: Fatih Dere, Konya (TR)

(72) Inventor: Mehmet Dere, Konya (TR)

(73) Assignee: Fatih Dere, Konya (TR)

( * ) Notice: Subject to any disclaimer, the term of this patent is extended or adjusted under 35 U.S.C. 154(b) by 38 days.

(21) Appl. No.: 18/910,049

(22) Filed: Oct. 9, 2024

(30) Foreign Application Priority Data

Sep. 16, 2024 (TR) ..... 2024/012229

(51) Int. Cl.
*F41A 5/12* (2006.01)
*F41A 3/72* (2006.01)

(52) U.S. Cl.
CPC . *F41A 5/12* (2013.01); *F41A 3/72* (2013.01)

(58) Field of Classification Search
CPC ..... F41A 5/12; F41A 5/08; F41A 3/46; F41A 3/72; F41A 19/46
See application file for complete search history.

(56) References Cited

U.S. PATENT DOCUMENTS 1,702,153 A * 2/1929 Chevallier ..... F41A 19/39 42/42.01
2,328,108 A * 8/1943 Swebilius ..... F41A 5/08 89/169
2,465,196 A * 3/1949 Browning ..... F41A 5/02 42/75.01
2,645,873 A * 7/1953 Crittendon ..... F41A 3/40 42/21
2,732,768 A * 1/1956 Browning ..... F41A 3/46 89/187.01
2,960,011 A * 11/1960 Bretton ..... F41A 3/66 89/182
3,901,126 A * 8/1975 Bretton ..... F41A 19/43 89/190
4,012,859 A * 3/1977 Johansson ..... F41A 3/66 42/17
5,983,549 A * 11/1999 Battaglia ..... F41A 25/12 42/17
8,733,009 B2 * 5/2014 Ricks ..... F41A 9/18 42/21
11,320,223 B2 * 5/2022 Pokalyaev ..... F41A 3/82
2016/0047610 A1 * 2/2016 Pittman ..... F41A 3/66 42/17
2018/0023907 A1 * 1/2018 Warburton ..... F41A 3/58 42/17
2019/0120579 A1 * 4/2019 Wilkinson ..... F41A 5/12
2019/0212085 A1 * 7/2019 Wilkinson ..... F41A 17/38
2022/0163277 A1 * 5/2022 Dere ..... F41A 3/46
2023/0221086 A1 * 7/2023 Moore ..... F41A 3/82 89/198

FOREIGN PATENT DOCUMENTS

TR 2019/17545 1/2020

* cited by examiner

*Primary Examiner* — Joshua E Freeman
(74) *Attorney, Agent, or Firm* — Bayramoglu Law Offices LLC

(57) ABSTRACT

An automatic firearm is provided, which operates with a system which unlocks the rifle with a certain force and makes it ready for firing again by using this energy, while the mechanism accelerates backwards with the force created by the pressure formed in the barrel after the weapon is fired, and the idle parts in the mechanism move forward due to inertia, creating create kinetic energy and includes apparatus suitable for this system.

6 Claims, 10 Drawing Sheets

AUTOMATIC FIREARM WITH PRESSURE CONTROLLED INERTIA MECHANISM

CROSS REFERENCE TO THE RELATED APPLICATIONS

This application is based upon and claims priority to Turkish Patent Application No. 2024/012229, filed on Sep. 16, 2024, the entire contents of which are incorporated herein by reference.

TECHNICAL FIELD

The invention relates to an automatic firearm which operates with a system which unlocks the rifle with a certain force and makes it ready for firing again by using this energy, while the mechanism accelerates backwards with the force created by the pressure formed in the barrel after the weapon is fired, and the idle parts in the mechanism move forward due to inertia, creating create kinetic energy and includes apparatus suitable for this system.

BACKGROUND

The working systems of the rifle used in automatic hunting rifles in the known technique and the technical problems in these systems are as follows;

Gas systems are a system that aims to work by opening the lock by pushing the lever back to the rifle by means of the piston in the gas chamber by providing gas passage through the hole or holes located at a certain distance from the barrel. After unlocking, the mechanism group, which is similar in all systems, moves the empty cartridge case backwards, ejects the empty cartridge case, inserts the new loaded cartridge into the barrel with the effect of the recolt spring, and at the same time stores the energy required for firing in the hammer spring, making the rifle ready for the next shot.

Technical problems in the gas system are that the cartridges in different grams (strengths, pressures) open at the same point due to the fact that the hole in the barrel is at a certain distance. Due to the fact that the hole is located at the same point, the pressure of different cartridges is different at that point. Therefore, since strong cartridges create higher pressure at that point, the mechanism and lever block accelerate more violently backwards, causing it to hit and damage the rifle. Weak cartridges cause it to operate hard or not operate at all. Although gas evacuation systems were built to eliminate this imbalance in the system, full balance could not be achieved. Additionally, the technical issues experienced with this system include excessive gas leakage due to the presence of a hole in the barrel and more difficult maintenance compared to other systems. However, despite these negativities, it is still the most used system because it works better at low grams compared to inertial systems.

The inertia system takes advantage of the backward acceleration that occurs when the rifle is fired and compresses the thick spring between the lock and the mechanism during the forward movement of the mechanism relative to the rifle under the influence of the inertia force. This spring then throws the mechanism back and unlocks it. Then, together with the mechanism group, it moves the empty casing back, throws the empty casing, puts the new loaded cartridge into the barrel with the effect of the recolt spring, and at the same time stores the energy required for firing in the hammer spring. Thus, it makes the rifle ready for the next shot again.

Although the inertia system works more stable than the gas system in different grams of cartridges, not all cartridges have been able to work equally. Because cartridges of different powers cannot compress the thick spring that runs the rifle in the same amounts, the operation of the rifle will not be the same. Since it is a very sensitive system, it is very difficult to operate with weak cartridges. There is a problem of not operating even with medium force cartridges in cold weather and well-shouldered shots.

Movable barrel systems are the system found in the first automatics built in history, but it has lost its validity because it is worse than the other systems mentioned above. The locked barrel mechanism is based on the logic of pushing the block back with complete movement. In short-moving barrels, the barrel hits and stops after a little movement, but the lever opens the lock at this speed and moves the empty barrel back with the mechanism group. Then it ejects the empty cartridge. It puts the new loaded cartridge into the barrel with the effect of the recolt spring and at the same time stores the energy required for firing in the hammer spring. Thus, it makes the rifle ready for the next shot again. These impacts make stable operation impossible as they will differ in different cartridges. In addition, it will cause some parts of the rifle to break, deteriorate and target deviations as it will cause excessive impact on strong cartridges.

Semi-locking delayed opening systems are the use of the system used in some military rifled shotguns (such as g3) in smoothbore military shotguns. Since standard bullets are fired in rifled shotguns, it is possible to achieve a delay time. However, in smoothbore rifles, it is not possible to set the delay time as standard for cartridges of different power. Therefore, the operation of this system in smoothbore rifles causes serious problems.

In the system we described in our patent application numbered TR2019 17545, we set out to solve all the problems experienced in unlocking the rifle in automatic smoothbore rifles fired using cartridges of different powers. However, in the system we described in our application, the mechanism could not be installed smoothly every time due to the problems experienced in storing the energy that will occur when the mechanism hits the case.

SUMMARY

The invention relates to an automatic firearm which operates with a system which unlocks the rifle with a certain force and makes it ready for firing again by using this energy, while the mechanism accelerates backwards with the force created by the pressure formed in the barrel after the weapon is fired, and the idle parts in the mechanism move forward due to inertia, creating create kinetic energy and includes apparatus suitable for this system.

Among the systems in the known art, our invention is distinguished by the inertia weight operating inside the mechanism, the inertia spring, the charging handle that can unlock the rifle during the first installation, the position of the recolt spring and the mechanism drop button with the technical effect created. Our invention is clearly distinguished in terms of storing the pressure formed in the barrel after the gun is fired in pressure-controlled automatic firearms in the known technique and using this pressure stored in the installation of the mechanism.

Figure 1:
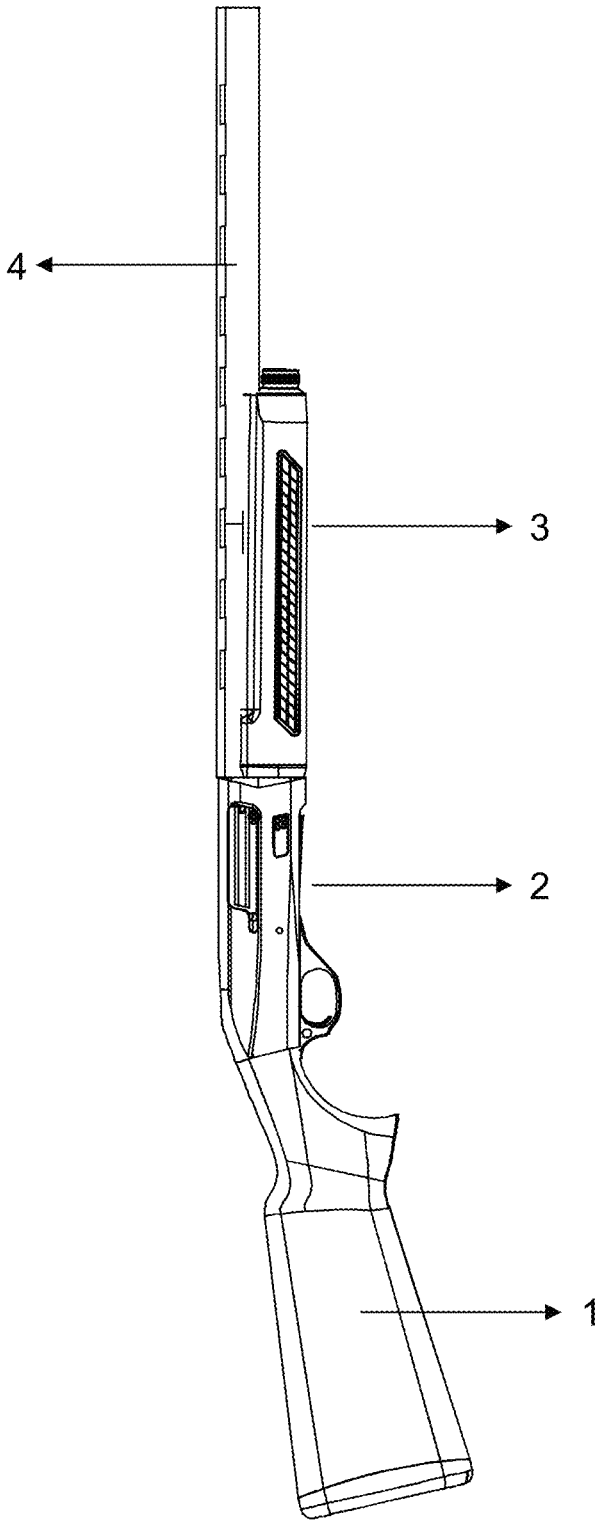
FIG. 1. Assembled View of Automatic Firearm
Figure 2:
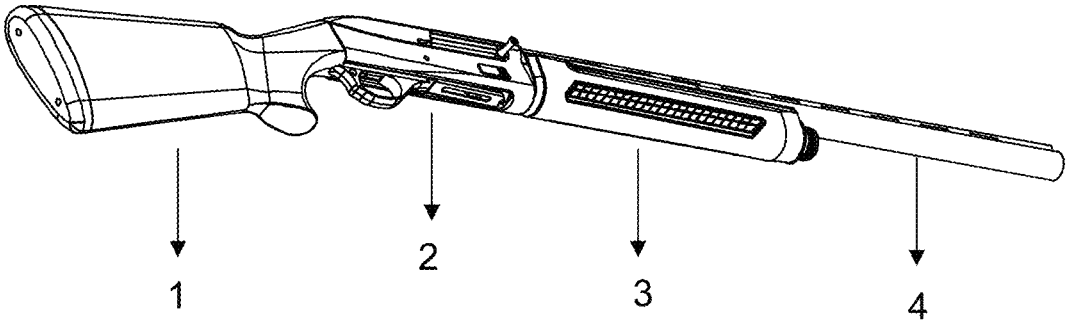
FIG. 2. Assembled Perspective View of Automatic Firearm
Figure 3:
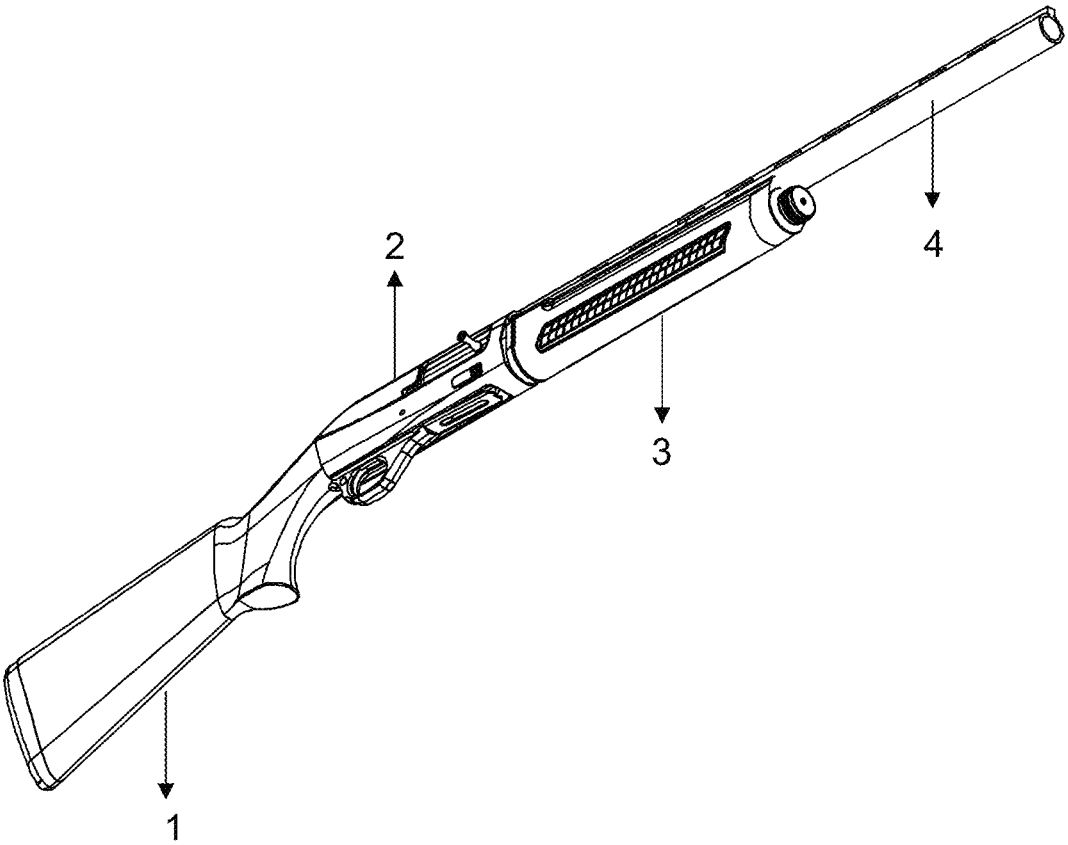
FIG. 3. Assembled Rear Perspective View of Automatic Firearm
Figure 4:
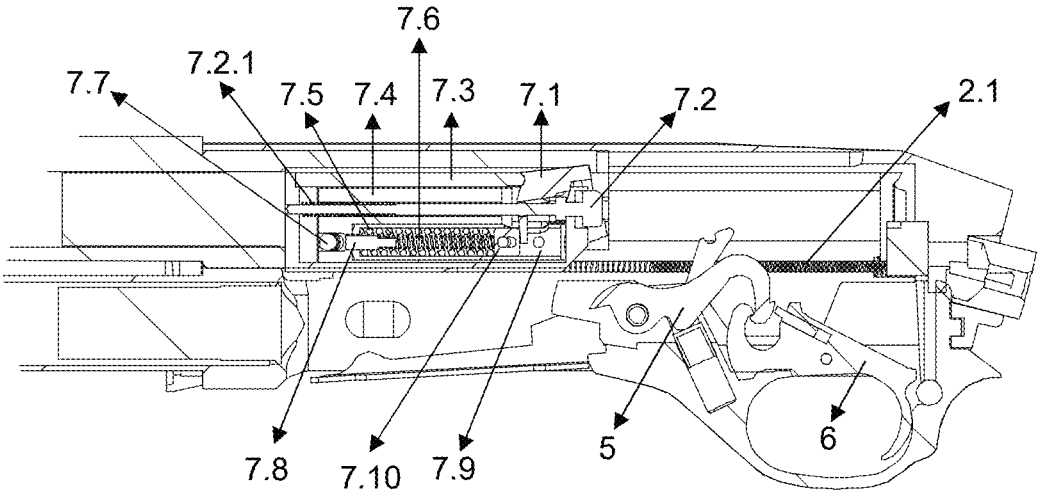
FIG. 4. Pressure Controlled Inertia Mechanism Ready to Shoot View
Figure 5:
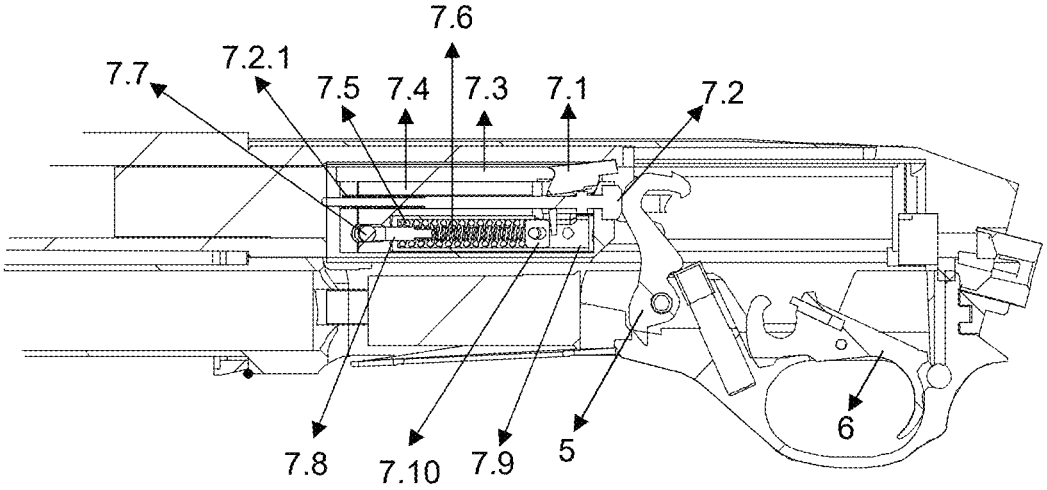
FIG. 5. Moment of Firing View of Pressure Controlled Inertia Mechanism
Figure 6:
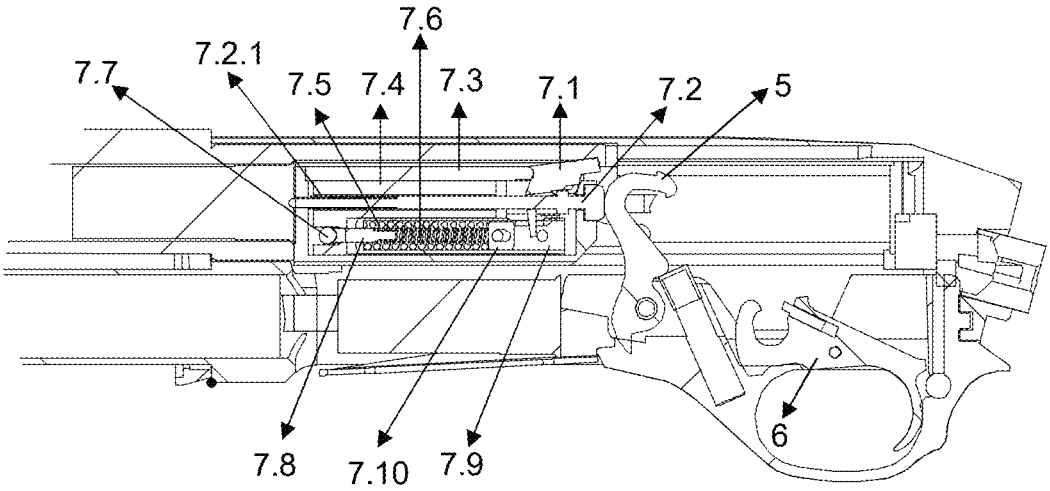
FIG. 6. View Showing the Inertia Pin in Contact with the Rifle Lock as the Free Parts in the Pressure Controlled Inertia Mechanism Move Forward FIG. 7. Moment View of the Force of the Inertia Spring in the Pressure Controlled Inertia Mechanism Unlocking by Overcoming the Friction Force on the Locking Bearing of the Rifle Lock FIG. 8. Moment View of the Mechanism Receding with the Remaining Pressure in the Barrel After the Rifle is Unlocked and Discharging the Empty Cartridge FIG. 9. View of the Firearm Ready to Fire Again by Dragging the Loaded Cartridge into the Barrel FIG. 10. Horizontal Sectional Display of the Recolt Spring Position in the Body FIG. 11. Vertical Sectional Display of the Recolt Spring Position in the Body FIG. 12. Side View with Pressure Controlled Inertia Mechanism and Lever Charging Handle Mounted FIG. 13. Cross-Sectional View of Levered charging handle in Free Position FIG. 14. Cross-Sectional View Showing Levered charging handle Unlocking Movement FIG. 15. Mechanism Drop Button Perspective View FIG. 16. Mechanism Drop Button Side View FIG. 17. Mechanism Drop Button Sectional View FIG. 18. Exploded View of Pressure Controlled Inertial Mechanism The reference numbers shown in the figures.
Figure 7:
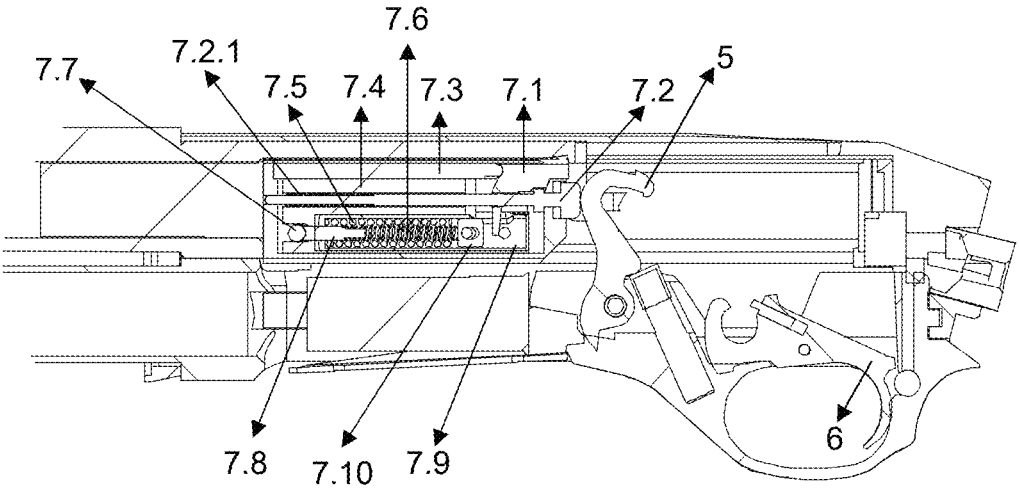
Figure 8:
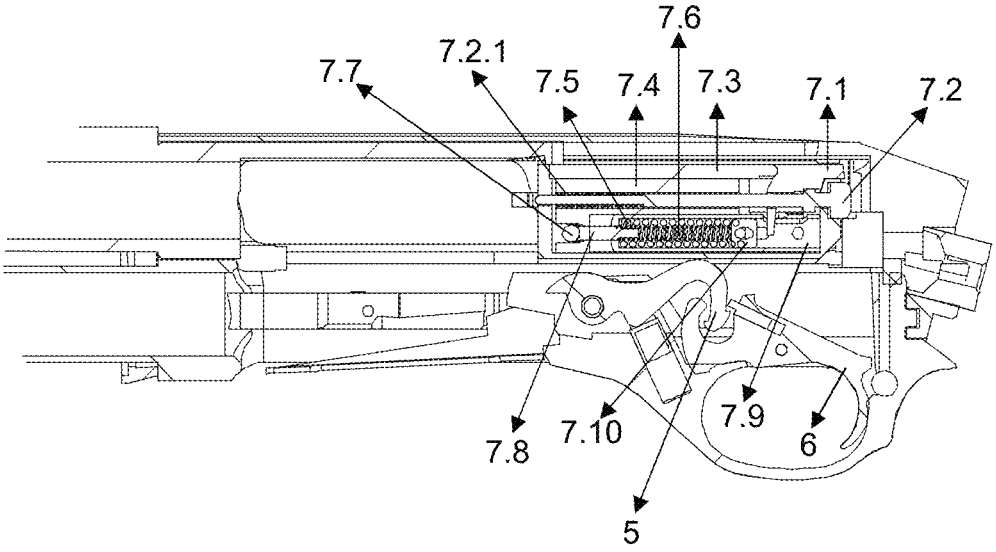
Figure 9:
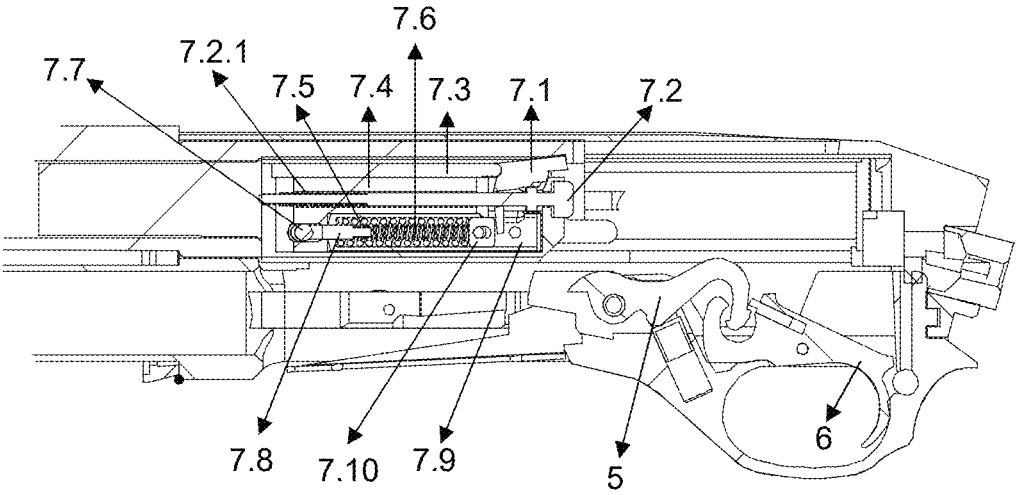
Figure 10:
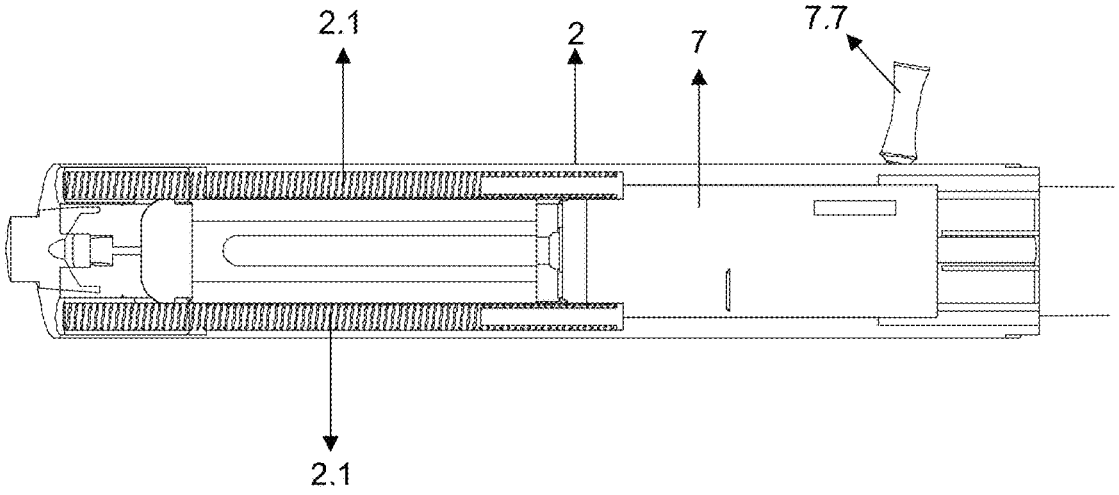
Figure 11:
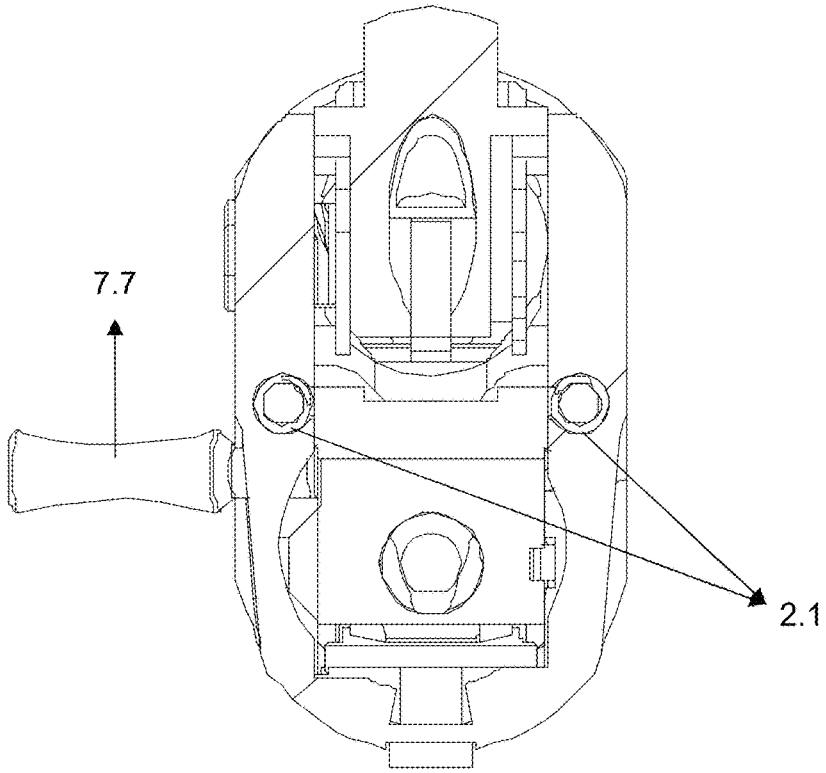
Figure 12:
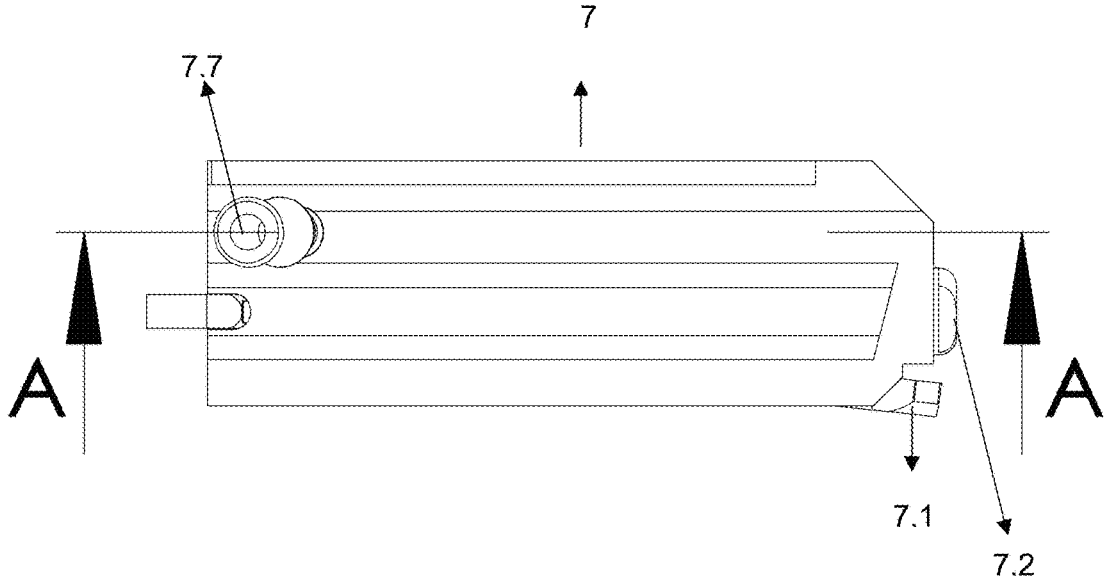
Figure 13:
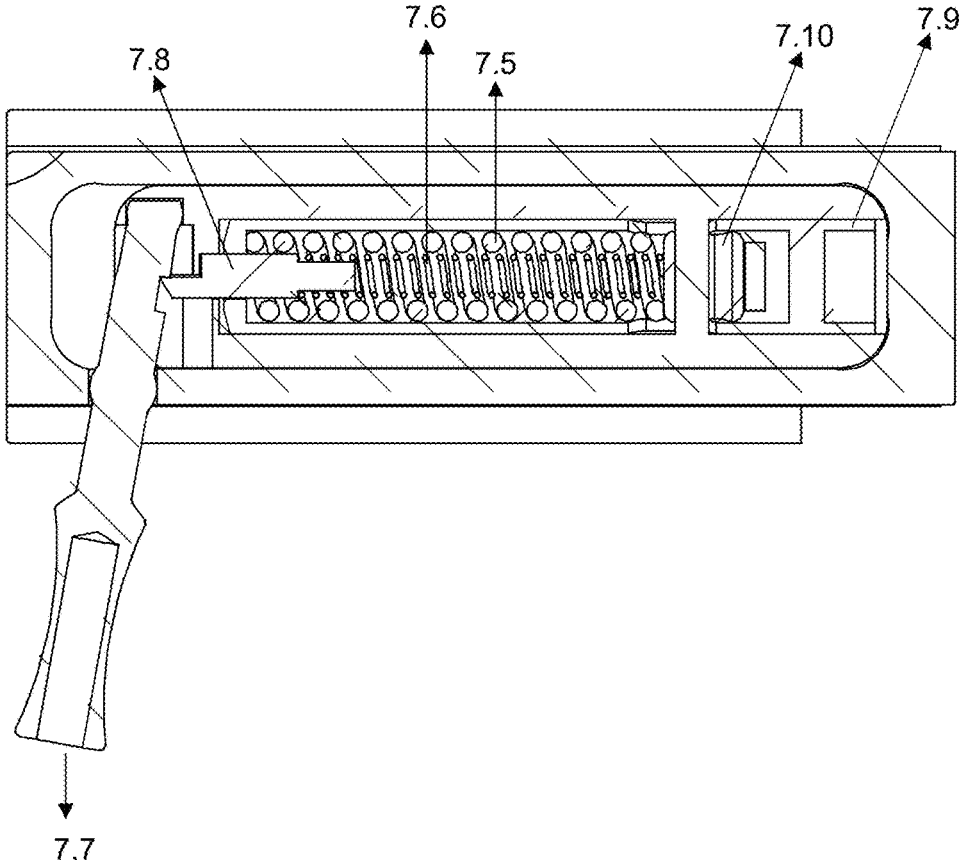
Figure 14:
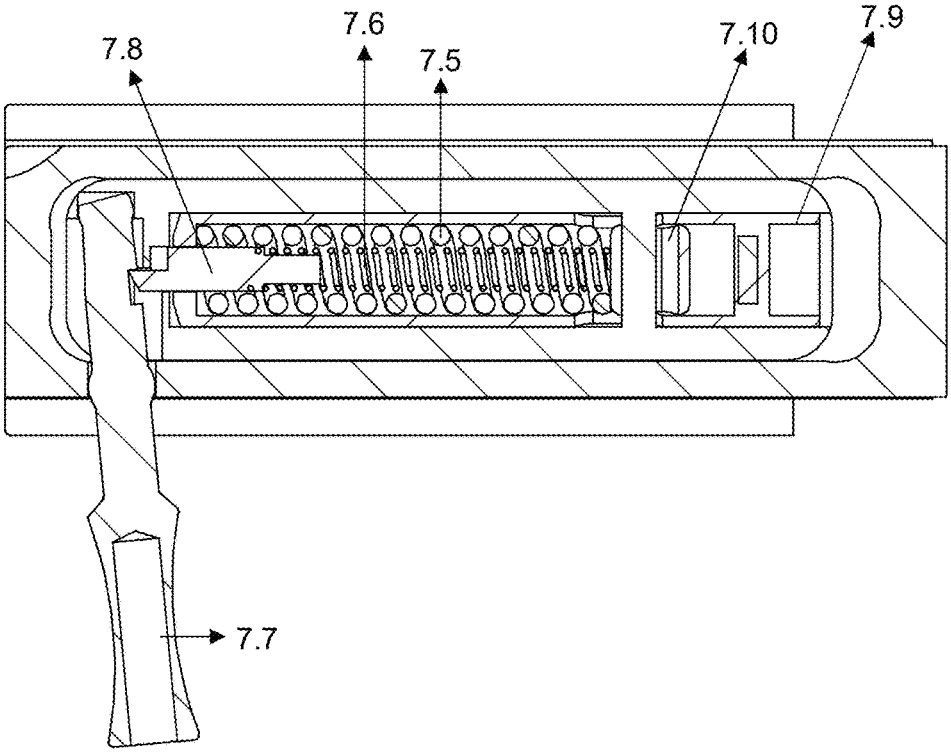
Figure 15:
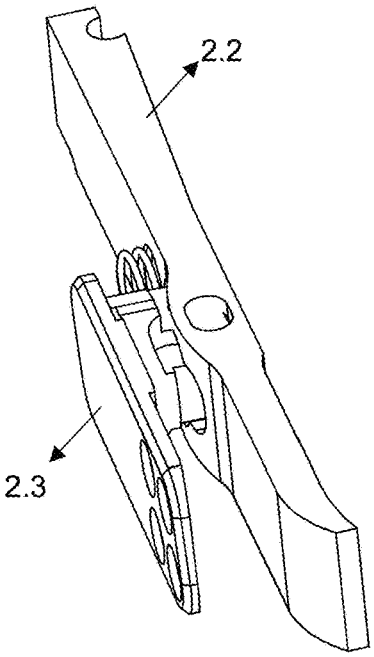
Figure 16:
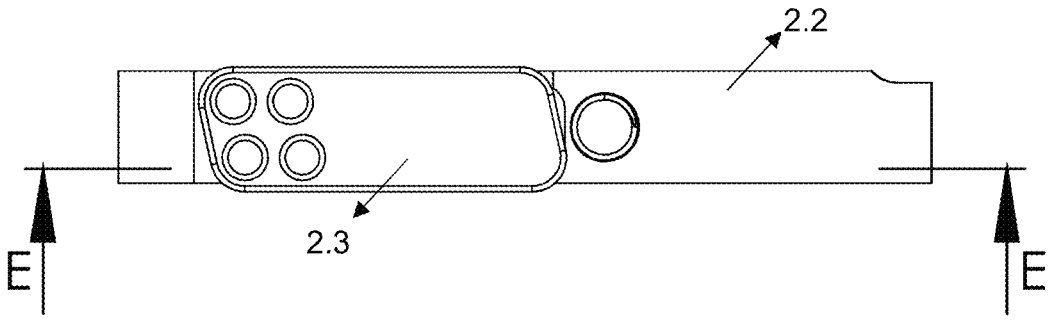
Figure 17:
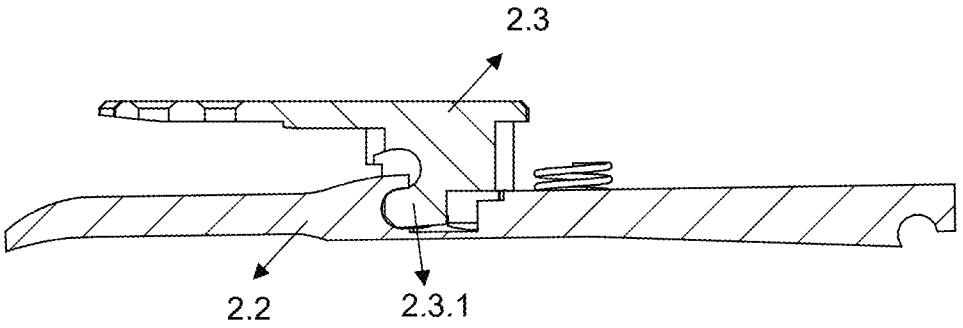
Figure 18:
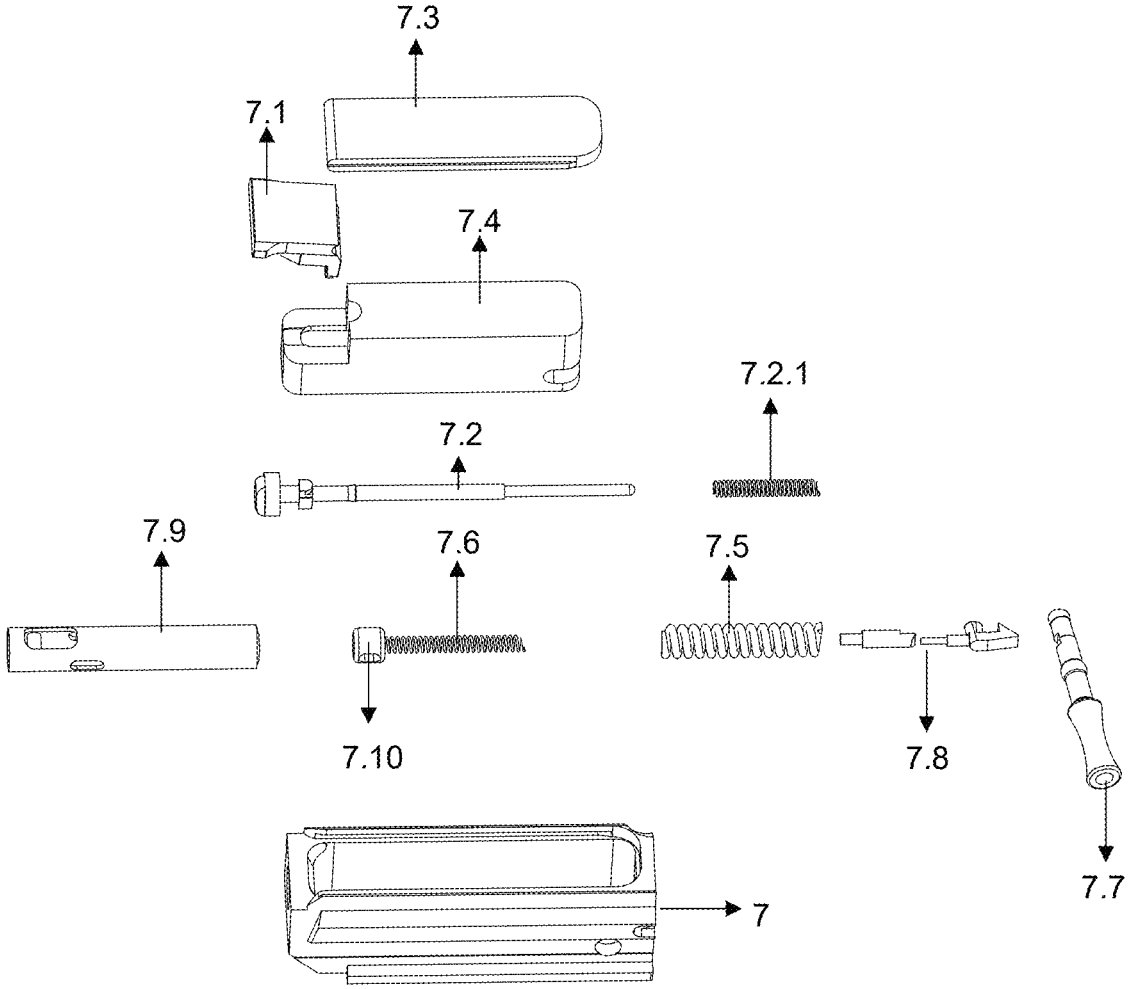

1. Stock
2. Body
  2.1 Recolt Spring
  2.2 Side Sheet
  2.3 Button
    2.3.1 Button Clamp
3. Fore-end
4. Gun barrel
5. Hammer
6. Trigger
7. Pressure-Controlled Inertia Mechanism
  7.1 Lock
  7.2 Needle.
    7.2.1 Needle Spring
  7.3 Mechanism Cover
  7.4 Inertial Weight
  7.5 Inertial Spring
  7.6 Charging handle
  7.7 Lever Charging handle
  7.8 Charging handle pin
  7.9 Inertia Pin
  7.10 Unlocking Pin

DETAILED DESCRIPTION OF THE EMBODIMENTS

The invention is characterized by a pressure-controlled inertia mechanism (7) comprising the body (2) consisting of button (2.3) parts including the stock (1), the recolt spring (2.1), the side sheet (2.2), the button clamp (2.3.1) section, the for-end (3), the barrel (4), the hammer (5), the trigger (6) and the lock (7.1), the needle (7.2) containing the needle spring (7.2.1), the mechanism cover (7.3), the inertia weight (7.4), the inertia spring (7.5), the charging handle spring (7.6), the lever charging handle (7.7), the charging handle pin (7.8), the inertia pin (7.9), the unlocking pin (7.10).

When the automatic firearm of the invention is fired using cartridges of different weights, the pressure in the barrel (4) accelerates the pressure-controlled inertia mechanism (7) backwards, and the inertia spring (7.5), the charging handle spring (7.6), the charging handle (7.7), the charging handle pin (7.8), the inertia pin (7.9), the unlocking pin (7.10) parts in the pressure-controlled inertia mechanism (7) all move forward as a group with the effect of inertia. In this way, the inertia pin (7.9) rests on the leg of the lock (7.1) and begins to exert pressure thereon as much as the force of the inertia spring (7.5). This pressure applied by the inertia pin (7.9) to the leg of the lock (7.1) cannot enable the lock (7.1) to be opened until it overcomes the frictional force between the lock (7.1) and the lock bearing. The friction force between the lock (7.1) and the lock bearing decreases as the pressure in the barrel (4) gradually decreases in the post-shooting process. Thus, when the friction force is lower than the force of the inertia spring (7.5), the lock (7.1) is opened by the force applied by the inertia spring (7.5) to the inertia pin (7.9). In this way, it is ensured that the pressure-controlled inertia mechanism (7) works smoothly in all different weight cartridges. After unlocking (7.1), the pressure-controlled inertia mechanism (7) completes its backward movement with the ideal pressure in the barrel (4) and rests on the end of the body (2). Meanwhile, the body (2) compresses at least one placed recolt spring (2.1) of the side walls and establishes the trigger mechanism. In the meantime, the empty cartridge is thrown out of the rifle. Thanks to the energy stored in the recolt spring (2.1), the pressure-controlled inertia mechanism (7) moves forward in the body (2) and drives the loaded cartridge into the barrel. Thus, the rifle is ready to shoot again.

Since the lock (7.1) in the automatic firearm subject to the invention can be opened while the pressure-controlled inertia mechanism (7) is moving forward, the lever charging handle (7.7) is used during the preparation of the rifle for the first shot. The lever charging handle (7.7) operates with the parts of the charging handle spring (7.6), the charging handle pin (7.8) and the unlocking pin (7.10). While the lever charging handle (7.7) is pulled backwards before the first shot, the inertia weight (7.4), inertia spring (7.5), inertia pin (7.9), unlocking pin (7.10) pull all the parts forward with the help of the charging handle pin (7.8) to open the lock (7.1). When the lever charging handle (7.7) is released, the unlocking pin (7.10) activates the lock (7.10) by pressing on the leg of the lock (7.1) by allowing the same group to move backwards with the effect of the charging handle spring (7.6). Since the rifle locks in all firearms in the known art are opened as the moving parts of the mechanism move backwards, it is completely different from the rifle of our invention. In the rifle subject to our invention, the lock is opened by moving forward.

The button (2.3) on the body (2) is mounted to the body (2) with the help of a pin in rifles of known art and operates by rotating around this pin. Without the need for the use of pins in the firearm subject to our invention, the button (2.3.1) is mounted to the body (2) with the help of the button clamp (2.3.1) and this button operates by rotating around the clamp (2.3.1). Thus, ease of assembly is provided without the need to use extra parts.

What is claimed is:

1. An automatic firearm with a pressure-controlled inertia mechanism, comprising:

at least one recoil spring located in side walls of a body, and a pressure-controlled inertial mechanism, comprising:

a lock, a needle comprising a needle spring, a mechanism cover, an inertia weight, an inertia spring, a lever charging handle, and an inertia pin.

2. The automatic firearm according to claim 1, wherein the body comprises a button mounted with a help of a button clamp and working by rotating around the button clamp.

3. The automatic firearm according to claim 1, wherein the pressure-controlled inertia mechanism comprises the inertia weight, the inertia spring, a charging handle spring, the lever charging handle, a charging handle pin, the inertia pin, and an unlocking pin, wherein the inertia weight, the inertia spring, the charging handle spring, the lever charging handle, the charging handle pin, the inertia pin, and the unlocking pin are movable and move forward with an inertia effect, while the pressure-controlled inertia mechanism moves backwards with a pressure effect formed in a barrel during a shooting using cartridges of different weights.

4. The automatic firearm according to claim 1, wherein the lever charging handle comprises a charging handle spring, a charging handle pin, and an unlocking pin.

5. The automatic firearm according to claim 1, wherein the lever charging handle allows the lock to be opened by pulling all parts of the inertia weight, the inertia spring, the inertia pin, and an unlocking pin forward with a help of a charging handle pin.

6. The automatic firearm according to claim 1, wherein in the lever charging handle, the inertia weight, the inertia spring, the inertia pin, and an unlocking pin all move backwards with an effect of a charging handle spring when released, and the unlocking pin activates the lock by pressing on a leg of the lock.

* * * * *